US005236803A

United States Patent [19]

Ono et al.

[11] Patent Number: 5,236,803

[45] Date of Patent: Aug. 17, 1993

[54] COLOR LIGHT-SENSITIVE MATERIAL WITH HYDROQUINONE REDUCING AGENT

[75] Inventors: Michio Ono; Takeshi Nakamine; Hiroyuki Hirai, all of Kanagawa, Japan

[73] Assignee: Fuji Photo Film Co., Ltd., Kanagawa, Japan

[21] Appl. No.: 918,612

[22] Filed: Jul. 27, 1992

[30] Foreign Application Priority Data

Jul. 26, 1991 [JP] Japan ..... 3-208754

[51] Int. Cl.[5] ..... G03C 5/54; G03C 1/48; G03C 1/42; G03C 7/26

[52] U.S. Cl. ..... 430/214; 430/218; 430/442; 430/505; 430/551; 430/559; 430/566

[58] Field of Search ..... 430/214, 218, 551, 484, 430/485, 442, 566, 372, 559, 505

[56] References Cited

U.S. PATENT DOCUMENTS

| | | | |
|---|---|---|---|
| 4,198,239 | 4/1980 | Credner et al. | 430/551 |
| 4,277,553 | 7/1981 | Onodera et al. | 430/551 |
| 4,732,845 | 3/1988 | Keiji et al. | 430/551 |
| 4,978,606 | 12/1990 | Ohki et al. | 430/218 |
| 5,026,634 | 6/1991 | Ono et al. | 430/551 |
| 5,032,487 | 7/1991 | Ono et al. | 430/218 |
| 5,153,109 | 10/1992 | Abe et al. | 430/551 |

FOREIGN PATENT DOCUMENTS 0320821 9/1988 European Pat. Off. .

*Primary Examiner*—Richard L. Schilling
*Attorney, Agent, or Firm*—Sughrue, Mion, Zinn, Macpeak & Seas

[57] ABSTRACT

A color light-sensitive material comprising a support having thereon at least one light-sensitive layer containing light-sensitive silver halide, and further comprising in the at least one light-sensitive layer or any other layer, independently, a binder, a reducible dye-providing compound, and a reducing agent represented by formula (I):

(I)

wherein X represents —CO— or —$SO_2$—; $R^1$ and $R^2$, which may be the same or different, each represents an alkyl group, an aryl group or a heterocyclic group, any of which groups may be substituted; $R^3$ represents a hydrogen atom, a halogen atom, an aryl group, an acylamino group, an alkoxy group, an aryloxy group, an alkylthio group, an arylthio group, an acyl group, a sulfonyl group, a carbamoyl group or a sulfamoyl group, any of which groups may be substituted; $R^2$ and $R^3$ may be combined together to form a carbocyclic ring or a heterocyclic ring; and the reducing agent may be in the form of a dimer or a trimer through $R^1$ or $R^2$.

15 Claims, No Drawings

COLOR LIGHT-SENSITIVE MATERIAL WITH HYDROQUINONE REDUCING AGENT

FIELD OF THE INVENTION

This invention relates to a color light-sensitive material, and more particularly to a color light-sensitive material which gives a positive color image having a high density and good color reproducibility.

BACKGROUND OF THE INVENTION

Many systems for obtaining a positive color image by diffusion transfer processes have been proposed.

For example, U.S. Pat. Nos. 4,559,290, 4,356,249 and 4,358,525, JP-A-53-35533 (the term "JP-A" as used herein means an "unexamined published Japanese patent application"), JP-A-53-110827, JP-A-54-130927, JP-A-56-164342, JP-A-59-154445 and JP-A-62-215270 disclose methods wherein a dye providing compound of an oxidation type incapable of releasing a dye, is allowed to coexist with a reducing agent or a precursor thereof. The reducing agent, being present in an amount corresponding to the exposure amount of silver halide, is oxidized by wet development or heat development and the compound is reduced by the reducing agent left behind, without being oxidized to release a diffusing dye. EP-A-220746 and Japanese Published Technical Report (Kokai Giho) 87-6199 (Vol. 12, No. 22) disclose color light-sensitive materials using a non-diffusing compound capable of releasing a diffusing dye by the reductive cleavage of an N-X bond (wherein X is an oxygen atom, a nitrogen atom or a sulfur atom), as the compound capable of releasing a diffusing dye by a similar mechanism to that described above.

However, it has been found that there is a problem in that dye images are highly stained when the aforesaid reducible dye providing compound together with a reducing agent or a precursor are used in combination with a silver halide emulsion.

The use of a diffusing electron transfer agent in addition to a non-diffusing electron donor as a reducing agent is effective in inhibiting the staining of the positive image-forming light-sensitive material using the aforesaid reducible dye providing compound. However, the oxidant of the electron transfer agent formed by development diffuses into other layer having different color sensitivities where the electron donor is oxidized. Thus, the density of the image is lowered and color reproducibility is deteriorated. An attempt has been made to reduce the oxidant of the electron transfer agent so diffused by providing an interlayer between light-sensitive layers having different color sensitivities from each other and containing a reducing agent in the interlayer.

However, in a diffusion transfer type light-sensitive material, there is a limitation on the amounts of a binder and a reducing agent which can be added to each layer from the viewpoints of image-forming rate, resolving degree, layer quality, etc. Accordingly, it has been desired to make further improvements in this regard.

For example, reducing agents described in U.S. Pat. No. 4,277,553, JP-A-61-75344 and JP-A-61-75348 are lacking in the ability of reducing the oxidant of the electron transfer agent diffused and can not sufficiently inhibit lowering in the density of the image in unexposed area.

Reducing agents described in U.S. Pat. Nos. 4,198,239 and 4,732,845, EP-A-351860, EP-A-284082 and EP-A-357040 and JP-A-63-198052 and JP-A-1-154151 can effectively reduce the oxidant of the electron transfer agent diffusing into the interlayer to thereby inhibit lowering in the density of the image in the unexposed area. However, such reducing agents themselves have strong reducing power, and hence a small amount of the reducing agent diffused reduces the reducible dye providing compound, and color turbidity is caused.

Accordingly, it is desirable that the reducing agent contained in an interlayer of a diffusion transfer type light-sensitive material has such characteristics that the agent has the ability to effectively reduce the oxidant of the electron transfer agent and the agent itself does not have an adverse influence on other layers and photographic characteristics as described above.

SUMMARY OF THE INVENTION

An object of the present invention is to increase the density of images and to improve color reproducibility in a color light-sensitive material containing a reducible dye providing compound.

The above and other objects and advantages in accordance with the present invention can be achieved by providing a color light-sensitive material comprising a support having thereon at least one light-sensitive layer containing a light-sensitive silver halide, and further comprising in the at least one light-sensitive layer or any layer, independently, a binder, a reducible dye providing compound and a reducing agent represented by formula (I):

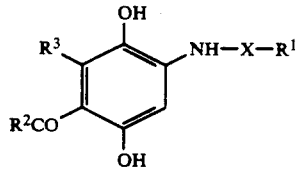

(I)

wherein X represents —CO— or —$SO_2$—; $R^1$ and $R^2$, which may be the same or different, each represents an alkyl group, an aryl group or a heterocyclic group, any of which groups may be substituted; $R^3$ represents a hydrogen atom, a halogen atom, an aryl group, an acylamino group, an alkoxy group, an aryloxy group, an alkylthio group, an arylthio group, an acyl group, a sulfonyl group, a carbamoyl group or a sulfamoyl group, any of which groups may be substituted; $R^2$ and $R^3$ may be combined together to form a carbocyclic ring or a heterocyclic ring; and the reducing agent may form a dimer or a trimer through $R^1$ or $R^2$.

DETAILED DESCRIPTION OF THE INVENTION

In formula (I), $R^1$ and $R^2$, which may be the same or different, each represents an alkyl group (including a substituted alkyl group, and having 1 to 100, preferably 1 to 50, more preferably 1 to 20 carbon atoms, e.g., methyl, ethyl, n-propyl, isopropyl, hexyl, 2-ethylhexyl, 2-hexyldecyl, n-dodecyl, n-heptadecyl), an aryl group (including a substituted aryl group, and having 6 to 100, preferably 6 to 50, more preferably 6 to 26 carbon atoms, e.g., phenyl, naphthyl) or a heterocyclic group (including a substituted heterocyclic group, and having 1 to 100, preferably 1 to 50, more preferably 1 to 20 carbon atoms, e.g., 2-pyridyl, 2-furyl, benzoxazolyl).

As noted, each of these alkyl, aryl and heterocyclic groups may be optionally substituted by at least one substituent group. Examples of suitable substituent groups include an alkyl group having 1 to 99 carbon atoms, an aryl group having 6 to 99 carbon atoms (e.g., phenyl, naphthyl), an alkyloxy group having 1 to 99 carbon atoms (e.g., methoxy, myristyloxy, methoxyethyloxy), an aryloxy group having 6 to 99 carbon atoms (e.g., phenyloxy, 2,4-di-tert-amylphenoxy, 3-tert-butyl-4-hydroxyphenyloxy, naphthyloxy), a carboxyl group, an alkylcarbonyl group having 2 to 99 carbon atoms (e.g., acetyl, tetradecanoyl), an arylcarbonyl group having 6 to 99 carbon atoms (e.g., benzoyl), an alkoxycarbonyl group having 2 to 99 carbon atoms (e.g., methoxycarbonyl benzyloxycarbonyl), an aryloxycarbonyl group having 7 to 99 carbon atoms (e.g., phenyloxycarbonyl, p-tolyloxycarbonyl), an acyloxy group having 2 to 99 carbon atoms (e.g., acetyl, benzoyloxy, phenylaminocarbonyloxy), a sulfamoyl group having 1 to 99 carbon atoms (e.g., N-ethylsulfamoyl, N-octadecylsulfamoyl), a carbamoyl group having 2 to 99 carbon atoms (e.g., N-ethylcarbamoyl, N-methyldodecylcarbamoyl), a sulfonamido group having 1 to 99 carbon atoms (e.g., methanesulfonamido, benzenesulfonamido, ethylaminosulfonamido), an acylamino group having 2 to 99 carbon atoms (e.g., acetylamino, benzamido, ethoxycarbonylamino, phenylamino carbonylamino), a diacylamino group having 4 to 99 carbon atoms (e.g., succinimido, hydantoinyl), a sulfonyl group having 1 to 99 carbon atoms (e.g., methanesulfonyl), a hydroxyl group, a cyano group, a nitro group and a halogen atom.

In formula (I), $R^3$ represents a hydrogen atom, a halogen atom (e.g., chlorine atom, fluorine atom), a substituted or unsubstituted aryl group (having 6 to 100, preferably 6 to 50, more preferably 6 to 20 carbon atoms, e.g., phenyl, naphthyl), a substituted or unsubstituted acylamino group (having 2 to 100, preferably 2 to 50, more preferably 2 to 20 carbon atoms, e.g. acetylamino, n-butaneamido, 2-hexyldecaneamido, 2-(2',4'-di-t-amylphenoxy)-butaneamido, benzoylamino), a substituted or unsubstituted alkoxy group (having 1 to 100, preferably 1 to 50, more preferably 1 to 20 carbon atoms, e.g., methoxy, ethoxy, butoxy, n-octyloxy, methoxyethoxy), a substituted or unsubstituted aryloxy group (having 6 to 100, preferably 6 to 50, more preferably 6 to 20 carbon atoms, e.g., phenoxy, 4-t-octylphenoxy), a substituted or unsubstituted alkylthio group (having 1 to 100, preferably 1 to 50, more preferably 1 to 20 carbon atoms, e.g., butylthio, hexadecylthio), a substituted or unsubstituted arylthio group (having 6 to 100, preferably 6 to 50, more preferably 6 to 20 carbon atoms, e.g., phenylthio, 4-dodecyloxyphenylthio), a substituted or unsubstituted acyl group (having 2 to 100, preferably 2 to 50, more preferably 2 to 20 carbon atoms, e.g., acetyl, benzoyl, lauroyl), a substituted or unsubstituted sulfonyl group (having 1 to 100, preferably 1 to 50, more preferably 1 to 20 carbon atoms, e.g., methanesulfonyl, octanesulfonyl, benzenesulfonyl, dodecylbenzenesulfonyl), a substituted or unsubstituted carbamoyl group (having 1 to 100, preferably 1 to 50, more preferably 1 to 20 carbon atoms, e.g., N,N-dioctylcarbamoyl) or a substituted or unsubstituted sulfamoyl group (having 0 to 100, preferably 0 to 50, more preferably 0 to 20 carbon atoms, e.g., N-butylsylfamoyl, N,N-di-methylsulfamoyl). Examples of suitable substituent groups are the same as those difined for $R^1$ and $R^2$.

In formula (I), $R^2$ and $R^3$ may be combined together to preferably form a five-membered to eight-membered carbocyclic ring or heterocyclic ring. The compound may be in the form of a dimer or a trimer through $R^1$ or $R^2$.

X represents —CO— or —$SO_2$— with —CO— being preferred.

In formula (I), the sum total of carbon atoms in $R^1$, $R^2$ and $R^3$ is at least 20, but not more than 200, preferably 20 to 100, more preferably 20 to 60.

In formula (I), $R^3$ is preferably a hydrogen atom or a halogen atom.

Examples of the compound of formula (I) which can be used in the present invention include, but are not limited to, the following compounds.

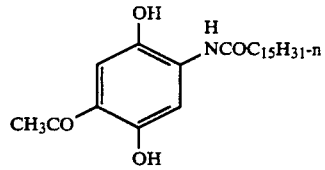

(1)

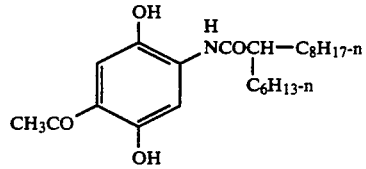

(2)

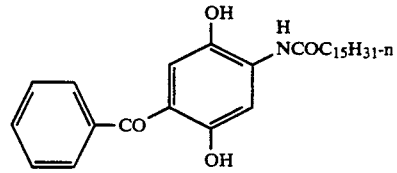

(3)

-continued
(4)
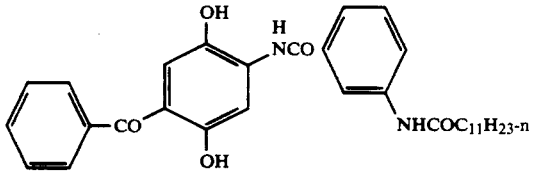
(5)
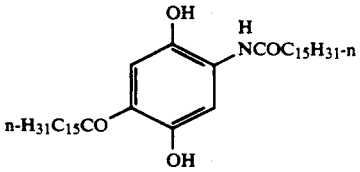
(6)
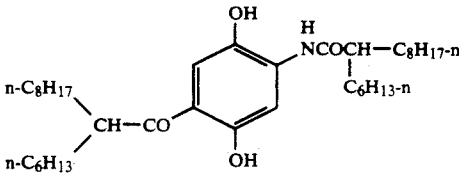
(7)
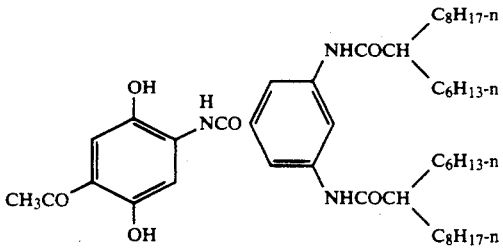
(8)
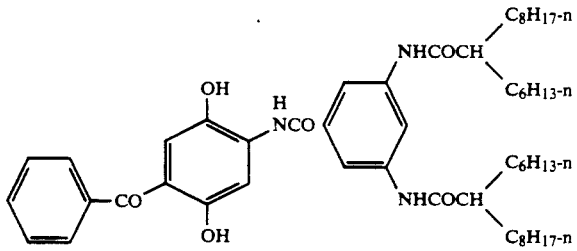
(9)
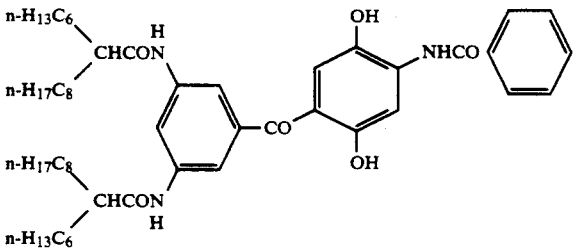
(10)
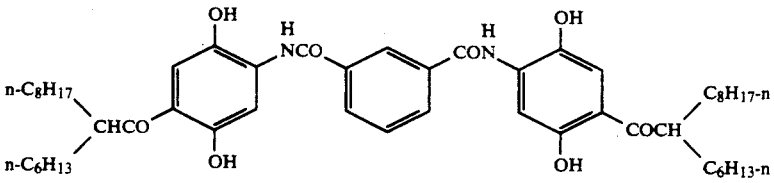

-continued
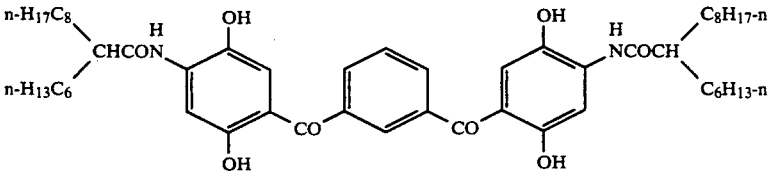
(11)
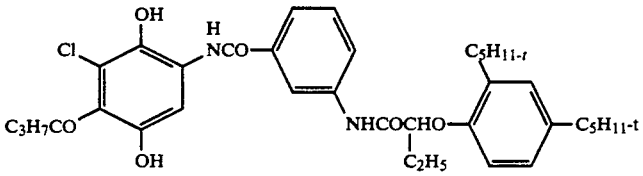
(12)
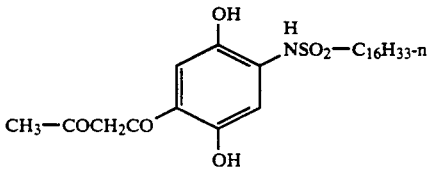
(13)
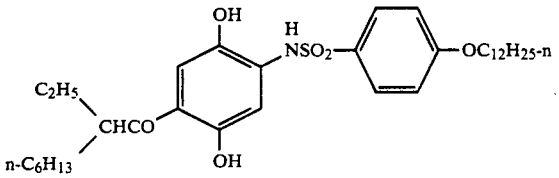
(14)
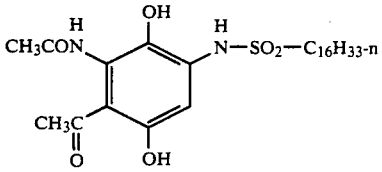
(15)
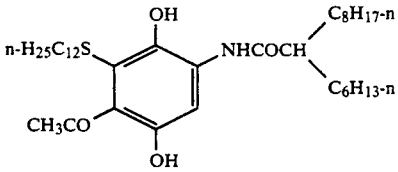
(16)
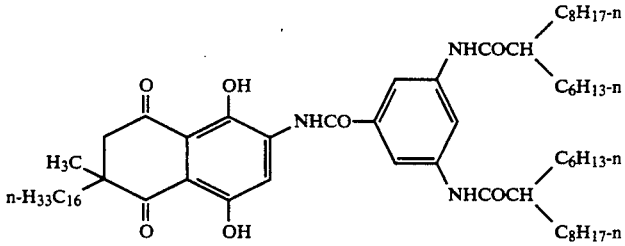
(17)
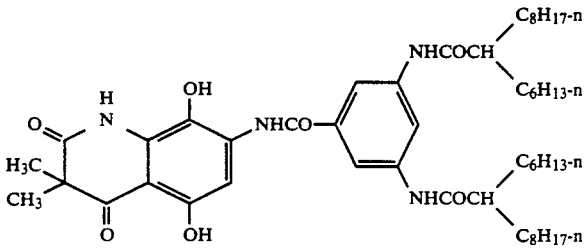
(18)

-continued
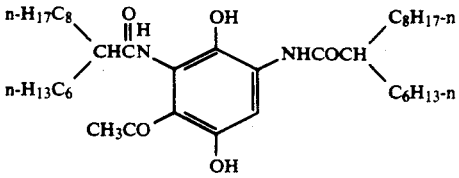
(19)
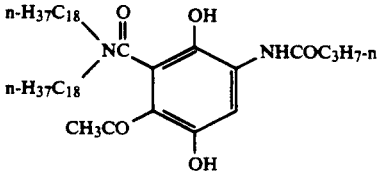
(20)
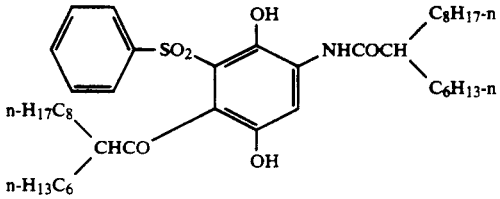
(21)
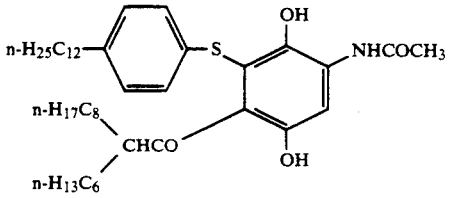
(22)
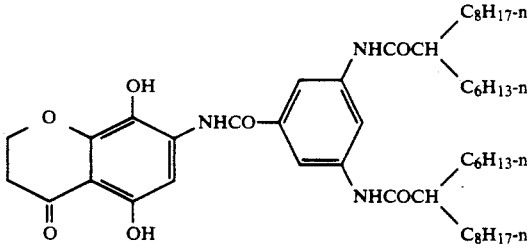
(23)
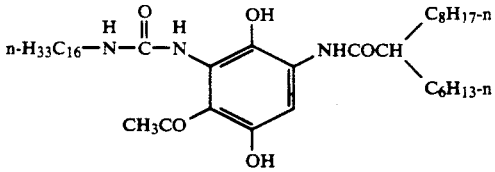
(24)
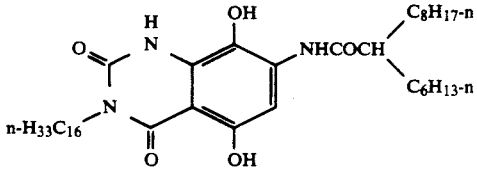
(25)
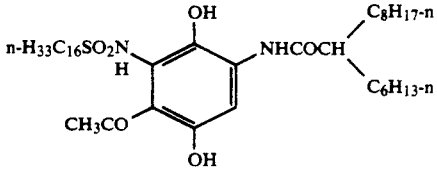
(26)

-continued

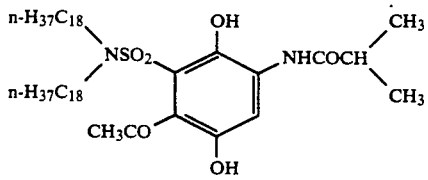

(27)

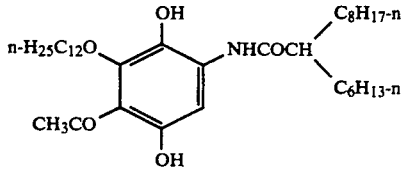

(28)

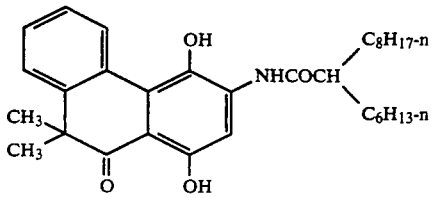

(29)

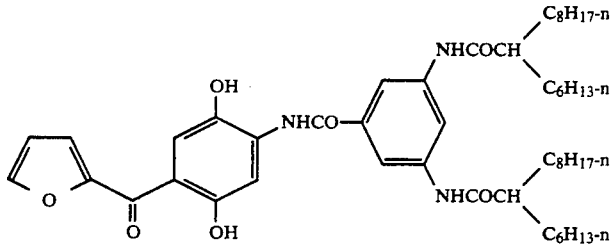

(30)

The compounds of the present invention can be synthesized by the following synthesis examples and by referring to the methods of the synthesis examples.

SYNTHESIS EXAMPLE 1

Synthesis of Compound (1)

(1) Synthesis of N-(2,5-dimethoxyphenyl) hexadecanoylamide (1-A)

In 2 liters of acetonitrile and 96 ml of pyridine was dissolved 142.5 g of 2,5-dimethoxyaniline. While cooling the resulting solution with ice and stirring it, 268.6 g of hexadecanoyl chloride was added dropwise thereto. After completion of dropwise addition, the mixture was stirred at room temperature for 3 hours. The precipitated crystal was recovered by filtration, washed with acetonitrile and dried to obtain 351.4 g of the compound (1-A). Yield: 96.4%.

(2) Synthesis of N-(4-acetyl-2,5-dimethoxyphenyl)hexadecanoylamide (1-B)

In 150 ml of methylene chloride were dissolved 16.3 ml of acetyl chloride and 30.6 g of aluminum chloride. While cooling the resulting solution with ice, 30 g of the compound (1-A) obtained above was added thereto. The mixture was stirred at room temperature for one hour. The reaction mixture was then poured into 200 ml of ice water. After the mixture was stirred for 30 minutes, methylene chloride was distilled off under reduced pressure. The precipitated crystal was recovered by filtration and recrystallized from acetonitrile to obtain 28.7 g of the compound (1-B). Yield: 86.4%.

(3) Synthesis of Compound (1)

In 150 ml of toluene was dissolved 27 g of the compound (1-B). To the resulting solution, there was added 18.3 g of aluminum chloride. The mixture was stirred at 80° C for 2 hours. The reaction mixture was then poured into 300 ml of ice water and extracted with ethyl acetate. The organic layer was concentrated, and the concentrate was crystallized from acetonitrile to obtain 12.3 g of the compound (1) as a light yellow crystal. Yield: 49%. Melting point: 145° to 146° C.

Elemental Analysis for $C_{24}H_{39}NO_4$:
Calculated (%): C: 71.08, H: 9.69, N: 3.45.
Found (%): C 70.91, H: 9.51, N: 3.55.

SYNTHESIS EXAMPLE 2

Synthesis of Compound (3)

(1) Synthesis of N-(4-benzoyl-2,5-dimethoxyphenyl)hexadecanoylamide (3-A)

In 150 ml of methylene chloride were dissolved 26.8 ml of benzoyl chloride and 30.6 g of aluminum chloride. While cooling the resulting solution with ice, 30 g of the compound (1-A) obtained above was added thereto. The mixture was stirred at room temperature for one hour. The reaction mixture was poured into 200 ml of ice water. The mixture was stirred for 20 minutes and extracted with methylene chloride. The extract was concentrated and the resulting oily material was purified by means of silica gel column chromatography to obtain 15 g of the compound (3-A). Yield: 86.4%.

(2) Synthesis of Compound (3)

In 50 ml of toluene was dissolved 15 g of the compound (3-A) obtained above. To the resulting solution, there was added 10 g of aluminum chloride. The mixture was stirred at 80° C for 3 hours. The reaction mixture was then poured into 100 ml of ice water and extracted with ethyl acetate. The organic layer was concentrated, and the concentrate was crystallized from acetonitrile to obtain 8.1 g of compound (3) as a light yellow crystal. Yield: 85.7%. Melting point: 97° to 98° C.

Elemental Analysis for $C_{29}H_{41}NO_4$
Calculate (%): C: 74.48, H: 8.34, N: 3.00.
Found (%): C: 74.19, H: 8.72, N: 3.16.

SYNTHESIS EXAMPLE 3

Synthesis of Compound (7)

(1) Synthesis of N-(2,5-dimethoxyphenyl)-3,5-dinitrobenzamide (7-A)

In 2 l of acetonitrile, 1.2 l of dimethylacetamide and 0.186 l of pyridine was dissolved 306.4 g of 2,5-dimethoxyaniline. While cooling the resulting solution with ice, 507.8 g of 3,5-dinitrobenzoyl chloride was slowly added thereto. While keeping the temperature of the reaction mixture at 15° C., the mixture was stirred for 3 hours and poured into 600 ml of water. The precipitated crystal was recovered by filtration, washed with acetonitrile and dried to obtain 737.5 g of the compound (7-A). Yield: 99%.

(2) Synthesis of N-(2,5-dimethoxyphenyl)-3,5-diaminobenzamide (7-B)

In 0.28 l of water and 1.8 l of isopropanol were dispersed 413 g of reduced iron and 41 g of ammonium chloride. While the dispersion was heated under reflux, 320 g of the compound (7-A) obtained above was slowly added thereto over a period of 35 minutes. After the mixture was heated under reflux for 30 minutes, solids were recovered from the reaction mixture by filtration. 5 l of water was poured into the filtrate. The precipitated crystal was recovered by filtration and dried to obtain 203 g of the compound (7-B). Yield: 77%.

(3) Synthesis of N-(2,5-dimethoxyphenyl)-3,5-bis(2-hexyldecaneamido) benzamide (7-C)

In 1.5 l of acetonitrile and 133 ml of pyridine was dissolved 220 g of the compound (7-B) obtained above. While cooling the resulting solution with ice and stirring it, 431.45 g of 2-hexyldecanoyl chloride was added dropwise thereto. After completion of dropwise addition, the mixture was stirred at room temperature for 2 hours, and 800 ml of water was added to the reaction mixture. The mixture was extracted with one liter of ethyl acetate. The organic layer was concentrated under reduced pressure. The concentrate was crystallized from 3 l of hexane to obtain 429.9 g of the compound (7—C). Yield: 75%.

(4) Synthesis of N-(4-acetyl-2,5-dimethoxyphenyl)-3,5-bis(2-hexyldecaneamido)-benzamide (7-D)

In 1.6 l of methylene chloride were dissolved 168 ml of acetyl chloride and 315 g of aluminum chloride. While cooling the resulting solution with ice, 400 g of the compound (7-C) obtained above was added thereto. The mixture was stirred at room temperature for one hour. The reaction mixture was then poured into 10 l of ice water, and the mixture was stirred for one hour. The methylene chloride layer was separated, washed twice with water and concentrated under reduced pressure. To the concentrate, there was added 2 of acetonitrile. The mixture was heated under reflux for one hour and then left to stand to cool it to room temperature. The resulting crystal was recovered by filtration to obtain 383 g of the compound (7-D). Yield: 93%.

(5) Synthesis of Compound (7)

In 1.7 l of toluene was dissolved 300 g of the compound (7-D) obtained above. To the resulting solution, there was added 228 g of aluminum chloride. The mixture was stirred at 80° C. for one hour. The reaction mixture was poured into 2 l of ice water and extracted with ethyl acetate. The organic layer was concentrated, and the concentrate was crystallized from n-hexane/ethyl acetate (one liter/0.3 liter) to obtain 181 g of the compound (7) as a light yellow crystal. Yield: 61%. Melting point: 198° to 199° C.

Elemental Analysis for $C_{47}H_{75}N_3O_6$
Calculated (%): C: 72.55, H: 9.71, N: 5.40.
Found (%): C: 72.34, H: 9.68, N: 5.61.

The reducing agents of the present invention may be added to any layer from among silver halide emulsion layers, colorant layers, interlayers, protective layers, undercoat layers, etc. However, it is particularly preferred that the reducing agents are added to the interlayers or the protective layers. The amount of the reducing agent to be added to each layer is preferably 0.05 to 50 mmol, particularly preferably 0.1 to 5 mmol per $m^2$ of the support, or preferably 0.01 to 50 mmol, particularly preferably 0.1 to 5 mmol per one gram of the binder in the layer to which the reducing agent is added.

The reducing agents of the present invention may be added to these layers by any of oil dispersion method, polymer dispersion method, fine grain dispersion method, etc.

In a particularly preferred embodiment, the color light-sensitive material of the present invention comprises a support having thereon at least two light-sensitive layers having different color sensitivities from each other and containing reducible dye providing compounds capable of forming or releasing diffusing dyes having different color hue from each other, and having an interlayer between the light-sensitive layers, wherein the interlayer contains a reducing agent of general formula (1).

In general, the light-sensitive material comprises a support, a light-sensitive silver halide, a binder, a reducible dye providing compound and the above-described reducing agent, and optionally further contains an organic metal salt oxidizing agent, an electron transfer agent, etc.

These components are often added to the same layer, but can be added to separate layers in a manner so that they can be reacted with each other. For example, a colored dye providing compound may be present in a layer under the silver halide emulsion layer to thereby prevent sensitivity from being lowered. It is preferred that an electron transfer agent is incorporated in the light-sensitive material. However, the electron transfer agent may be supplied from an external source, for example, by a method wherein the electron transfer agent is dispersed from a dye fixing element or a processing solution as described hereinafter.

At least three silver halide emulsion layers having light sensitivity in different spectral regions from one another may be used in combination to obtain color over a wide range within the chromaticity diagram by the three primary colors of yellow, magenta and cyan colors. For example, a combination of the three layers of a blue-sensitive layer, a green-sensitive layer and a red-sensitive layer and a combination of a green-sensitive layer, a red-sensitive layer and an infrared-sensitive layer can be used. These light-sensitive layers can be arranged in various orders used for conventional color light-sensitive materials. Each of these light-sensitive layers may itself comprise two or more layers.

The light-sensitive material may be provided with various conventional auxiliary layers such as protective layer, undercoat layer, interlayer, yellow filter layer, antihalation layer, back layer, etc.

Any of silver chloride, silver bromide, silver iodobromide, silver chlorobromide, silver chloroiodide and silver chloroiodobromide can be used as silver halide in the present invention.

Silver halide emulsions which are suitable used in the present invention include a surface latent image type emulsion and an internal latent image type emulsion. The internal latent image type emulsion in combination with a nucleating agent or a light fogging agent can be used as a direct reversal emulsion. Further, there may be used a core/shell emulsion wherein the interior of the grain has a different phase from that of the surface layer thereof. The silver halide emulsion may be a monodispersed type or a polydispersed type. A mixture of monodispersed emulsions may be used. Silver halide grains have a grain size of preferably 0.1 to 2 $\mu$m, particularly preferably 0.2 to 1.5 $\mu$m. The crystal habit of the silver halide grains may be any of cubic, octahedral and tetradecahedral. Tabular grains having a high aspect ratio can also be used.

More specifically, any of the silver halide emulsions described in U.S. Pat. Nos. 4,500,626 (50th column) and 4,628,021, *Research Disclosure* (hereinafter abbreviated to RD) 17029 (1978) and JP-A-62-253159 can be used.

Non-after-ripened silver halide emulsions as such may be used. Usually, the silver halide emulsions are chemically-sensitized. The emulsions can be sensitized by conventional sulfur sensitization methods, reduction sensitization methods, noble metal sensitization methods and selenium sensitization methods singly or in combination. These chemical sensitization methods can be carried out in the presence of a nitrogen-containing heterocyclic compound (see, JP-A-62-53159), if desired.

The coating weight of the light-sensitive silver halide in the present invention is generally in the range of 1 to 10 g/m$^2$ in terms of silver.

In the present invention, organic metal salts as oxidizing agents can be used in combination with the light-sensitive silver halide. Among organic metal salts, organic silver salts are particularly preferred.

Examples of organic compounds which can be used to form the organic silver salt oxidizing agents include benzotriazoles, fatty acids and other compounds described in U.S. Pat. No. 4,500,626 (52nd and 53rd columns). The silver salts of carboxylic acids having an alkynyl group such as silver propiolate described in JP-A-60-113235 and acetylene silver described in JP-A-61-249044 are also useful. The organic silver salts may be used alone or in a combination of two or more of them.

The organic silver salts are generally used in an amount of 0.01 to 10 mol, preferably 0.01 to 1 mol per mol of light-sensitive silver halide. The combined coating weight of the light-sensitive silver halide and the organic silver salt is preferably 50 mg to 10 g/m$^2$ in terms of silver.

In the present invention, various anti-fogging agents or photographic stabilizers can be used. Examples of such compounds include azoles and azaindenes described in RD 17643, pp. 24 to 25 (1978), nitrogen-containing carboxylic acids and phosphoric acids described in JP-A-59-168442, mercapto compounds and metal salts thereof described in JP-A-59-111636 and acetylene compounds described in JP-A-62-87957.

The silver halides which are used in the present invention may be spectrally-sensitized with methine dyes, etc. Examples of dyes which can be used in the present invention include cyanine dyes, merocyanine dyes, complex cyanine dyes, complex merocyanine dyes, holopolar cyanine dyes, hemicyanine dyes, styryl dyes and hemioxonol dyes.

Concretely, sensitizing dyes described in U.S. Pat. No. 4,617,257, JP-A-59-180550, JP-A-60-140335 and RD 17029, pp. 12 to 13 (1978) can be used.

These sensitizing dyes may be used alone or in a combination. A combination of the dyes are often used for the purpose of supersensitization.

In addition to the sensitizing dye, the emulsions may contain a dye which itself has no spectral sensitization effect or a compound which does not substantially absorb visible light, but has a supersensitization effect (e.g., those described in U.S. Pat. No. 3,615,641 and JP-A-63-23145).

These sensitizing dyes may be added before, during or after chemical ripening, or may be added before or after the nucleation of the silver halide grains according to U.S. Pat. Nos. 4,183,756 and 4,225,666. The sensitizing dyes are generally used in an amount of $10^{-8}$ to $10^{-2}$ mol per mol of silver halide.

Hydrophilic binders are preferred as a binder for the constituent layers of the light-sensitive material and the dye fixing element. Examples of suitable hydrophilic binders include those described in JP-A-62-253159 pp. 26 to 28. Transparent or semitransparent hydrophilic binders are preferred. Examples of such hydrophilic binders include natural compounds such as proteins, e.g., gelatin and gelatin derivatives, cellulose derivatives and polysaccharide, e.g., starch, gum arabic, dextran and pullulan, as well as synthetic high-molecular weight compounds such as polyvinyl alcohol, polyvinyl pyrrolidone, acrylamide polymers and other synthetic polymers. Further, highly water-absorbing polymers, i.e.,homopolymers of vinyl monomers having —COOM or —$SO_3M$ (wherein M is hydrogen atom or an alkali metal), copolymers of two or more of these vinyl monomers and copolymers of these vinyl monomers with other vinyl monomers (e.g., sodium methacrylate, ammonium methacrylate, Sumicagel L-5H manufactured by Sumitomo Chemical Co., Ltd.) described in JP-A-62-245260 can be used. These binders may be used alone or in a combination of two or more of them, as desired.

In a system wherein heat development is carried out by supplying a very small amount of water, the absorption of water can be rapidly made to occur by using the above-described highly water-absorbing polymers. Further, when the highly water-absorbing polymers are used in the dye fixing layer or a protective layer thereof, the dye can be prevented from being re-transferred form the dye fixing element to other materials after transfer.

In the present invention, the coating weight of the binder is preferably not more than 20 g, more preferably not more than 10 g, particularly preferably not more than 7 g, per $m^2$.

Various polymer latexes can be contained in the constituent layers (including any back layer) of the light-sensitive material or the dye fixing element to improve the physical properties of the layers, for example, to stabilize dimensions, to prevent curling, sticking or cracking from being caused and to prevent pressure from being increased or reduced. Specifically, any of the polymer latexes described in JP-A-62-245258, JP-A-62-136648 and JP-A-62-110066 can be used. Particularly, when polymer latexes having a low glass transition point (not higher than 40° C.) are used in a mordant layer, the mordant layer can be prevented from being cracked. When polymer latexes having a high glass transition point are used n the back layer, an anti-curling effect can be obtained.

In the present invention, the compounds of formula (I) can be used together with reducing agents which are conventionally used in the field of light-sensitive materials. Further, reducing agent precursors which themselves do not have a reducing effect, but function as reducing agents by the action of a nucleophilic reagent or heat during the course of development, can also be employed.

Examples of the reducing agents which can be used in the present invention include the reducing agents and precursors thereof described in U.S. Pat. Nos. 4,500,626 (49th to 50th columns), 4,483,914 (30th and 31st columns), 4,330,617 and 4,590,152, JP-A-60-140335 (pp. 17 to 18), JP-A-57-40245, JP-A-56-138736, JP-A-59-178458, JP-A-59-53831, JP-A-59-182449, JP-A-59-192450, JP-A-60-119555, JP-A-60-128436 to JP-A-60-128439, JP-A-60-198540, JP-A-60-181742, JP-A-61-259293, JP-A-62-244044, JP-A-62-131253 to JP-A-62-131256 and EP-A2-220746 (pp. 78 to 96).

The combinations of various reducing agents described in U.S. Pat. No. 3,039,869 can also be used.

When such a non-diffusing reducing agent as the compound of the present invention is used, an electron transfer agent and/or a precursor thereof in combination with the nondiffusing reducing agent may be optionally used to accelerate an electron transfer between the non-diffusing reducing agent and a developable silver halide.

The electron transfer agent or a precursor thereof can be chosen from among the aforesaid reducing agents or precursors thereof. It is desirable that the electron transfer agents or the precursors thereof are more mobile than the non-diffusing reducing agents (electron donors). Particularly preferred electron transfer agents are 1-phenyl-3-pyrazolidone compounds and aminophenol compounds.

The non-diffusing reducing agents (electron donors( to be used in combination with the electron transfer agents include the aforesaid reducing agents, so long as they are substantially immobile between the layers of the light-sensitive material. Preferred non-diffusing reducing agents are hydroquinones, sulfonamidophenols, sulfonamidonaphthols and compounds which are described as electron donors in JP-A-53-110827.

Reducing agents other than those of formula (I) are preferably used in an amount of 0.01 to 20 mol, particularly preferably 0.1 to 10 mol per mol of silver in the layer to which they are added.

The reducible dye providing compounds which can be used in the present invention include compounds having a function capable of releasing or diffusing imagewise a diffusing dye. The compounds of this type can be represented by the following formula (LI):

$$(\text{Dye}—\text{Y})_n—\text{Z} \qquad \text{(LI)}$$

wherein Dye represents a dye group, a temporarily short-waved dye group or a dye precursor group; Y represents a single bond or a bonding group; Z represents a reducible group which gives rise to a difference in the diffusibility of the compound represented by the formula of $(\text{Dye}—\text{Y})_n—\text{Z}$ in counter-correspondence to a reaction capable of reducing a light-sensitive silver halide to silver, or which releases Dye and gives rise to a difference in diffusibility between the released Dye and $(\text{Dye}—\text{Y})_n—\text{Z}$; n represents 1 or 2, and when n is 2, the two Dye-Y groups may be the same or different.

Concrete examples of the reducible dye providing compounds of formula (LI) include non-diffusing compounds which release a diffusing dye by reacting with a reducing agent left behind without being oxidized by development as described in U.S. Pat. No. 4,559,290, EP-A2-220746, U.S. Pat. No. 4,783,396 and Japanese Published Technical Report (Kokai Giho) 87-6199. More specifically, examples thereof include compounds which release a diffusing dye by an intramolecular nucleophilic substitution reaction after being reduced as described in U.S. Pat. Nos. 4,139,389 and 4,139,379, JP-A-59-185333 and JP-A-57-84453; compounds which release a diffusing dye by an intramolecular electron transfer reaction after being reduced as described in U.S. Pat. No. 4,232,107, JP-A-59-101649, JP-A-61-88257 and RD 24025 (1984); compounds which release a diffusing dye by the cleavage of a single bond after reduction as described in West German Patent 3,008,588A, JP-A-56-142530 and U.S. Pat. Nos. 4,343,893 and 4,619,884; nitro compounds which release a diffusing dye after electron acceptance as described in U.S. Pat. No. 4,450,223; and compounds which release a diffusing dye after electron acceptance as described in U.S. Pat. No. 4,609,610.

More preferred examples thereof include compounds having an electron attractive group and an N-X bond (wherein X is oxygen, sulfur or nitrogen atom) in the molecule as described in EP-A2-220746, Japanese Published Technical Report (Kokai Giho) 87-6199, U.S. Pat. No. 4,783,396, JP-A-63-201653 and JP-A-63-201654; compounds having an $SO_2$-X bond (wherein X is as defined above) and an electron attractive group in the molecule as described in JP-A-1-26842; compounds having a PO-X bond (wherein X is as defined above) and an electron attractive group in the molecule as described in JP-A-63-271344; and compounds having a C—X' bond (wherein X' has the same meaning as described above or is $—SO_2—$) and an electron attractive group in the molecule as described in JP-A-63-271341. There can also be used compounds which release a diffusing dye by the cleavage of a single bond after being reduced by $\pi$-bond conjugated with an electron accepting group as described in JP-A-1-161237 and JP-A-1-161342.

Among the above-described reducible dye providing compounds, the compounds having an N-X bond and an electron attractive group in the molecule are particularly preferred. Concrete examples of such compounds include compounds (1) to (3), (7) to (10), (12), (13), (15), (23) to (26), (31), (32), (35), (36), (40), (41), (44), (53) to (59), (64) and (70) described in EP-A2-220746 or U.S. Pat. No. 4,783,396 and compounds (11) to (23) described in Japanese Published Technical Report (Kokai Giho) 87-6199.

Hydrophobic additives, such as the dye providing compounds and the non-diffusing reducing agents, can be introduced into the layers of the light-sensitive material by conventional methods such as a method described in U.S. Pat. No. 2,322,027. In this case, there can be used high-boiling organic solvents described in JP-A-59-83154, JP-A-59-178451, JP-A-59-178452, JP-A-59-178453, JP-A-59-178454, JP-A-59-178455 and JP-A-59-178457, optionally together with low-boiling organic solvents having a boiling point of 50° to 160° C.

The high-boiling organic solvents are generally used in an amount of not more than 10 g, preferably not more than 5 g per one gram of the dye providing compound, or in an amount of preferably not more than 1 cc, more preferably not more than 0.5 cc, particularly preferably not more than 0.3 cc per one gram of the binder.

Dispersion methods using polymers as described in JP-B-51-39853 (the term "JP-B" as used herein means an "examined Japanese patent publication") and JP-A-51-59943 can also be used.

When compounds are substantially insoluble in water, the compounds can be dispersed in the binder in the form of fine particles to introduce them into the layers.

When hydrophobic compounds are dispersed in a hydrophilic colloid, various surfactants can be used. Examples of the surfactants include those described in JP-A-59-157636 (pp. 37 to 38).

The light-sensitive material of the present invention may contain compounds which activate development and stabilize the image. Examples of suitable compounds which can be preferably used include those described in U.S. Pat. No. 4,500,626 (51st and 52nd columns).

A dye fixing element together with the light-sensitive material is used in a system wherein an image is formed by the diffusion transfer of a dye. The dye fixing element and the light-sensitive material may be coated on separate supports, or on the same support. The relationship between the light-sensitive layer and the dye fixing element, the relationship with the supports and the relationship with a white light reflecting layer as described in U.S. Pat. No. 4,500,626 (57th column) can be applied to the present invention.

The dye fixing element preferably used in the present invention has at least one layer containing a mordant and a binder. Mordants which are known in the field of photography can be used. Examples of suitable mordants include those described in U.S. Pat. No. 4,500,626 (58th and 59th columns), JP-A-61-88256 (pp. 32 to 41), JP-A-62-244043 and JP-A-62-244036. Further, dye-accepting high-molecular weight compounds described in U.S. Pat. No. 4,463,079 may be used.

The dye fixing element may be provided with auxiliary layers such as a protective layer, a release layer, an anti-curling layer, etc. The provision of a protective layer is particularly useful.

The constituent layers of the light-sensitive material and the dye fixing element may contain plasticizers, slipping agents or high-boiling organic solvents as releasability improvers between the light-sensitive material and the dye fixing element. Concrete examples of these compounds include those described in JP-A-62-253159 (page 25) and JP-A-62-245253.

Further, various silicone oils (any of silicone oils ranging from dimethyl silicone to modified silicone oils obtained by introducing organic groups into dimethylsiloxane) can be used for the above-described purpose. For example, various modified silicone oils, particularly carboxyl group-modified silicone (Trade name: X-22-3710) described in Technical data p-6-18 B, "Modified Silicone Oil" issued by Shin-Etsu Silicone KK, are effectively used.

Silicone oils described in JP-A-62-215953 and JP-A-63-46449 are also effective.

The light-sensitive material and the dye fixing element may contain anti-fading agents. Suitable anti-fading agent include antioxidants, ultraviolet light absorbers and certain metal complexes.

Examples of suitable antioxidants include chroman compounds, coumaran compounds, phenolic compounds (e.g., hindered phenols), hydroquinone derivatives, hindered amine derivatives and spiro-indane compounds. Compounds described in JP-A-61-159644 are also effective.

Examples of suitable ultraviolet light absorbers include benzotriazole compounds (as described in U.S. Pat. No. 3,533,794), 4-thiazolidone compounds (as described in U.S. Pat. No. 3,352,681), benzophenone compounds (as described in JP-A-46-2784) and compounds described in JP-A-54-48535, JP-A-62-136641 and JP-A-61-88256. Further, ultraviolet light absorbing polymers described in JP-A-62-260152 are also effective.

Examples of suitable metal complexes include compounds described in U.S. Pat. Nos. 4,241,155, 4,245,018 (3rd to 36th columns) and 4,254,195 (3rd to 8th columns), JP-A-62-174741, JP-A-61-88256 (pp. 27 to 29), JP-A-63-199248, JP-A-1-75568 and JP-A-1-74272.

Examples of useful anti-fading agents are described in JP-A-62-215272 (pp. 125 to 137).

Anti-fading agents for preventing a dye transferred to the dye fixing element from being faded may be previously incorporated in the dye fixing element, or may be supplied to the dye fixing element from an external source such as the light-sensitive material.

The above-described antioxidants, ultraviolet light absorbers and metal complexes may be used in combination, if desired.

The light-sensitive material and the dye fixing element may contain a fluorescent brightener. It is particularly preferred that the fluorescent brightener is incorporated in the dye fixing element or is supplied from an external source such as the light-sensitive material. Examples of suitable fluorescent brighteners include compounds described in K. Veenkataraman, *The Chemistry of Synthetic Dyes,* Vol. V, Chapter 8 and JP-A-61-143752. More specifically, examples of such compounds include stilbene compounds, coumarin compounds, biphenyl compounds, benzoxazolyl compounds, naphthalimide compounds, pyrazoline compounds and carbostyryl compounds.

A combination of a fluorescent brightener and anti-fading agent can be used, if desired.

Hardening agents which can be used in the constituent layers of the light-sensitive material and the dye fixing element include those described in U.S. Pat. No. 4,678,739 (41st column), JP-A-59-116655, JP-A-62-

245261 and JP-A-61-18942. More specifically, examples of the hardening agents include aldehyde hardening agents (e.g., formaldehyde), aziridine hardening agents, epoxy hardening agents, vinyl sulfone hardening agents (e.g., N,N'-ethylene-bis(vinylsulfonylacetamido)ethane), N-methylol hardening agents (e.g., dimethylol urea) and high-molecular weight hardening agents (e.g., compounds described in JP-A-62-234157).

The constituent layers of the light-sensitive material and the dye fixing element may contain various surfactants as a coating aid or to improve releasability or slipperiness, to impart antistatic properties or to accelerate development. Concrete examples of suitable surfactants are described in JP-A-62-173463 and JP-A-62-183457.

The constituent layers of the light-sensitive material and the dye fixing element may contain organofluoro compounds to improve slipperiness or releasability or to impart antistatic properties. Typical examples of suitable organofluoro compounds include fluorine-containing surfactants described in JP-B-57-9053 (8th to 17th columns), JP-A-61-20944 and JP-A-62-135826 and hydrophobic fluoro compounds such as oily fluoro compounds, e.g., fluorine-containing oil and solid fluoro compound resins, e.g., tetrafluoroethylene resin.

The light-sensitive material and the dye fixing element may contain matting agents. Examples of suitable matting agents include compounds such as silicon dioxide, polyolefins and polymethacrylates described in JP-A-61-88256 (page 29) and compounds such as benzoguanamine resin beads, polycarbonate resin beads and AS resin beads described in JP-A-63-274944 and JP-A-63-274952.

Further, the constituent layers of the light-sensitive material and the dye fixing element may contain heat solvents, anti-foaming agents, antibacterial and antifungal agents and colloidal silica. Examples of these additives are described in JP-A-61-88256 (pp. 26 to 32).

In the present invention, the light-sensitive material and/or the dye fixing element may contain image forming accelerators. The image forming accelerators have functions capable of accelerating a redox reduction between the silver salt oxidizing agent and the reducing agent, a reaction for forming a dye from the dye providing material, a reaction for decomposing the dye or a reaction for releasing a diffusing dye and accelerating the migration of the dye from the light-sensitive material to the dye fixing layer. From the viewpoint of physical and chemical functions, the image forming accelerators can be classified into base or base precursor, nucleophilic compound, high-boiling organic solvent (oil), heat solvent, surfactant and compound having an interaction with silver or silver ion. However, these material groups have generally a composite function, and usually have two or more functions of the above-described accelerating effects. The details thereof are described in U.S. Pat. No. 4,678,739 (38th to 40th columns).

The base precursor includes the salts of bases with organic acids which are decarboxylated by heat and compounds which release an amine by an intramolecular nucleophilic substitution reaction, Lossen rearrangement or Beckmann rearrangement. Specific examples thereof are described in U.S. Pat. No. 4,511,493 and JP-A-62-65038.

In a system wherein heat development and the transfer of the dye are simultaneously carried out in the presence of a small amount of water, it is preferred from the viewpoint of enhancing the preservability of the light-sensitive material that the base and/or the base precursor are/is incorporated in the dye fixing element.

Further, as base precursors, the combinations of difficultly soluble metal compounds with compounds, referred to as complex forming compounds, capable of reacting with metal ions to form a complex (the metal ions being those which form the above difficultly soluble metal compounds), such as described in EP-A-210660 and U.S. Pat. No. 4,740,445, as well as compounds which form a base by electrolysis, as described in JP-A-61-232451. The former type of precursor is particularly effective. It is preferred that the difficultly soluble metal compound and the complex forming compound are separately added to the light-sensitive material and the dye fixing element, respectively.

When development is carried out by using a processing solution, the base and/or the base precursor may be contained in the processing solution, if desired.

In the present invention, the light-sensitive material and/or the dye fixing element may contain a development stopping agent to constantly obtain a uniform image, even though the processing temperature and the processing time fluctuate during the course of development.

The term "development stopping agent" as used herein refers to a compound which rapidly neutralizes the base or is rapidly reacted with the base after normal development to lower the concentration of the base in the layer and to thereby stop development, or a compound which restrains development by an interaction with silver and a silver salt. Concretely, examples of the development stopping agent include acid polymers which neutralize the base; acid precursors which release an acid by heating; electrophilic compounds which undergo a substitution reaction with the coexisting base; and nitrogen-containing heterocyclic compounds, mercapto compounds and precursors thereof. The details thereof are described, for example, in JP-A-62-253159 (pp. 31 to 32).

Materials capable of withstanding the processing temperature are used as supports for the light-sensitive material and the dye fixing element in the present invention. Generally, paper and synthetic high-molecular weight materials (films) are used. More specifically, examples of the materials which can be used as the supports include films of polyethylene terephthalate, polycarbonates, polyvinyl chloride, polystyrene, polypropylene, polyimides, celluloses (e.g., triacetylcellulose), films obtained by incorporating a pigment such as titanium dioxide in the films of these polymers, the films of synthetic paper made of polypropylene, etc., a blended pulp paper prepared from a synthetic resin pulp such as polyethylene and natural pulp, Yankee paper, barayta paper, coated paper (particularly cast coated paper), metals, cloth and glass.

These materials may be used alone. One side or both sides of the material may be laminated with a synthetic high-molecular weight material such as polyethylene, and the resulting laminated support may be used.

In addition, supports described in JP-A-62-253159 (pp. 29 to 31) can be used.

A hydrophilic binder, a semiconductive metal oxide such as alumina sol or tin oxide, carbon black and an antistatic agent may be coated on the surfaces of the supports.

Methods for exposing the light-sensitive material to light and recording an image thereon include a method wherein scenery, people or the like are directly photographed by using a camera; a method wherein exposure is made through a reversal film or a negative film by using a printer or an enlarger; a method wherein the original image is subjected to scanning exposure through a slit by using the exposure device of a copying machine; a method wherein image information is converted into electric signals, and exposure is made by emitting light from a light emitting diode or laser; and a method wherein image information is outputted to an image display device such as a CRT, a liquid crystal display, an electroluminescence display or a plasma display, and exposure is made directly or through an optical system.

Light sources for recording an image on the light-sensitive material include natural light, tungsten lamp, light emitting diodes, laser beam sources and CRT light sources as described in U.S. Pat. No. 4,500,626 (56th column).

The exposure of an image can be made by using a wavelength converting device composed of a combination of a non-linear optical element and a coherent light source such as laser beam. The term "non-linear optical material" as used herein refers to a material which exhibits non-linearity between an electric field and polarization formed when an intense photoelectrode such as a laser beam is applied thereto. Preferred examples of the material include inorganic compounds such as typically lithium niobate, potassium dihydrogen-phosphate (KDP), lithium iodate and $BaB_2O_4$; urea derivatives; nitroaniline derivatives; nitropyridine-N-oxide derivatives such as 3-methyl-4-nitropyridine-N-oxide (POM); and compounds described in JP-A-61-53462 and JP-A-62-210432. A single crystal light waveguide path type and a fiber type are known as suitable forms of the wavelength converting device. Any of them is useful.

Examples of picture signals from the above image information include picture signals obtained from a video camera and an electron still camera, television signals according to Nippon Television Signal Code (NTSC), picture signals obtained by dividing the original into many pixels by means of a scanner, and picture signals produced by means of a computer such as typically CG or CAD.

The light-sensitive material and/or the dye fixing element may be provided with an electrically conductive heating element layer as a heating means for heat development or the diffusion transfer of the dye. In this case the transparent or opaque heating element described in JP-A-61-145544 can be used. These electrically conductive layers function as an antistatic layer.

Development can be effected at a heating temperature of about 50° to about 250° C. in the heat development stage. A heating temperature in the range of about 80° to about 180° C. is particularly preferred. The diffusion transfer stage of the dye may be carried out simultaneously with heat development or after completion of the heat development stage. In the latter case, transfer can be effected in the transfer stage at a heating temperature ranging from the temperature in the heat development stage to room temperature. However, a heating temperature of not lower than about 50° C., but lower by about 10° C. than the temperature in the heat development stage is particularly preferred.

The transfer of the dye can be effected only by heat if desired, but also a solvent may be used to accelerate the transfer of the dye. A method wherein development and transfer are carried out simultaneously or continuously by heating in the presence of a small amount of a solvent (particularly water) as described in JP-A-59-218443 and JP-A-61-238056, is likewise useful. In this method, the heating temperature is preferably not lower than 50° C., but not higher than the boiling point of the solvent. For example, when the solvent is water, the heating temperature is preferably not lower than 50° C., but not higher than 100° C.

Examples of the solvent which may be used to accelerate development and/or to transfer the diffusing dye to the dye fixing layer include water and aqueous basic solutions containing an inorganic alkali metal salt or an organic base (examples of the base include those described above in the discussion of the image forming accelerators). Further, low-boiling solvents and mixed solutions of the low-boiling solvents and water or the aqueous basic solutions can be used. Furthermore, the solvents may contain surfactants, anti-fogging agents, difficultly soluble metal salts and complex forming compounds.

Methods for applying the solvent to the light-sensitive layer or the dye fixing layer include those described in JP-A-61-147244 (page 26). The solvent is encapsulated and may be previously incorporated in either one or both of the light-sensitive material and the dye fixing element.

Further, a method wherein the solvent is contained as a processing solution in a pod and uniformly spread between the light-sensitive material and the dye fixing layer may be employed.

A hydrophilic heat solvent which is a solid at room temperature, but which is molten at an elevated temperature may be contained in the light-sensitive material or the dye fixing element. The hydrophilic heat solvent may be contained in either one or both of the light-sensitive material and the dye fixing element. The heat solvent may be contained in any of the emulsion layer, the interlayer, the protective layer and the dye fixing layer, but it is preferred that the solvent is contained in the dye fixing layer and/or a layer adjacent thereto.

Examples of the heat solvent include ureas, pyridines, amides, sulfonamides, imides, alcohols, oximes and other heterocyclic compounds.

If desired, the high-boiling organic solvent may be contained in the light-sensitive material and/or the dye fixing element to accelerate the transfer of the dye.

Heating methods in the development stage and/or in the transfer stage include a method wherein the light-sensitive material is brought into contact with a heated block, a method wherein the light-sensitive material is brought into contact with a hot plate, a hot presser, a hot roller, a halogen lamp heater or an infrared or far infrared lamp heater, and a method wherein the light-sensitive material is passed through a high-temperature atmosphere.

A method for applying pressure to the laminate of the light-sensitive material and the dye fixing element and pressure conditions for bringing them in close contact with each other as described in JP-A-61-47244 (page 27) can be applied to the present invention.

Any of various heat development devices can be used to process the photographic element of the present invention. For examples, devices described in JP-A-59-75247, JP-A-59-177547, JP-A-59-181353, JP-A-60-18951 and JP-A-U-62-25944 (the term "JP-A-U" as used herein means an "unexamined published Japanese utility model application") can be preferably used. Development systems for general instant films can be also be used.

The present invention is now illustrated in greater detail by reference to the following Examples which, however, are not to be construed as limiting the present invention in any way.

EXAMPLE 1

A light-sensitive element having a layer structure as in the following Table 1 was prepared, and is referred to as light-sensitive element 101.

The silver halide emulsions used were prepared according to the description of page 25, line 54 to page 28, line 7 of EP-A-357040 (also in Example 2 and 3 of the present invention).

Further, a dye fixing element having a layer structure as indicated in the following Table 2-A was prepared, and is referred to as dye fixing element (1).

The fluorescent brightener (1), the antistaining agent (1) and the high-boiling organic solvent (1) in the second layer of the following Table 2-B were emulsified by using the surfactant (4) and added as an emulsion.

TABLE 1

The structure of light-sensitive element 101

| Layer No. | Name of layer | Additive | Coating weight (mg/m$^2$) |
|---|---|---|---|
| Sixth layer | Protective layer | Gelatin | 900 |
| | | Silica (particle size: 4 μm) | 40 |
| | | Zinc hydroxide | 900 |
| | | Surfactant (2) | 130 |
| Fifth layer | Blue-sensitive emulsion layer | Blue-sensitive silver halide emulsion | 380 in terms of silver |
| | | Yellow dye providing compound (1) | 400 |
| | | Gelatin | 600 |
| | | Electron donor (1) | 212 |
| | | High-boiling solvent (1) | 200 |
| | | Electron transfer agent precursor (1) | 15 |
| | | Anti-fogging agent (1) | 0.6 |
| | | Surfactant (1) | 46 |
| Fourth layer | Interlayer | Gelatin | 700 |
| | | Reducing agent A | 130 |
| | | Anti-fogging agent precursor (1) | 30 |
| | | High-boiling solvent (1) | 48 |
| | | Surfactant (2) | 61 |
| | | Electron transfer agent (1) | 80 |
| | | Hardening agent (1) | 37 |
| | | Surfactant (1) | 5 |
| Third layer | Green-sensitive emulsion layer | Green-sensitive silver halide emulsion | 220 in terms of silver |
| | | Magenta dye providing compound (2) | 365 |
| | | Gelatin | 310 |
| | | Electron donor (1) | 111 |
| | | High-boiling solvent (1) | 183 |
| | | Electron transfer agent precursor (1) | 15 |
| | | Anti-fogging agent (2) | 0.3 |
| | | Surfactant (1) | 33 |
| Second layer | Interlayer | Gelatin | 790 |
| | | Zinc hydroxide | 300 |
| | | Reducing agent A | 130 |
| | | High-boiling solvent (1) | 73 |
| | | Surfactant (2) | 100 |
| | | Surfactant (1) | 5 |
| | | Activated carbon | 25 |
| | | Anti-fogging agent precursor (1) | 30 |
| First layer | Red-sensitive emulsion layer | Red-sensitive silver halide emulsion | 230 in terms of silver |
| | | Cyan dye providing compound (3) | 343 |
| | | Gelatin | 330 |
| | | Electron donor (1) | 114 |
| | | High-boiling solvent (1) | 172 |
| | | Electron transfer agent precursor (1) | 17 |
| | | Anti-fogging agent (3) | 0.7 |
| | | Surfactant (1) | 33 |

Support: polyethylene terephthalate of 96 μm (carbon black was coated on the back layer)

Certain materials mentioned above are defined below:

Surfactant (1)

TABLE 1-continued
The structure of light-sensitive element 101
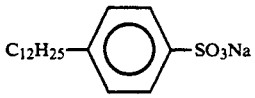
Anti-fogging agent (1)
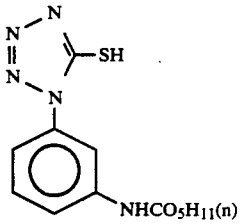
Electron donor (1)
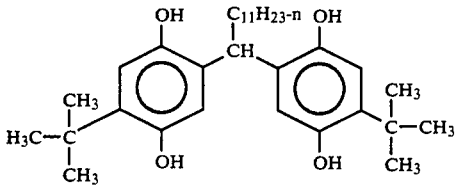
High-boiling solvent (1)
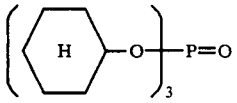
Electron transfer agent precursor (1)
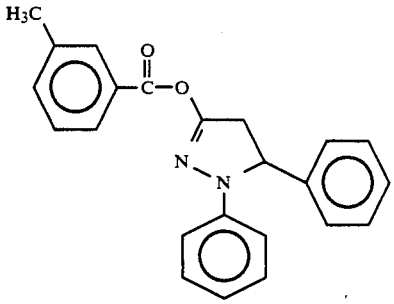
Surfactant (2)
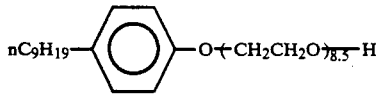
Electron transfer agent (1)
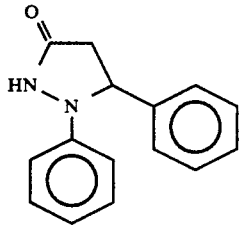

TABLE 1-continued
The structure of light-sensitive element 101
Anti-fogging agent precursor (1)
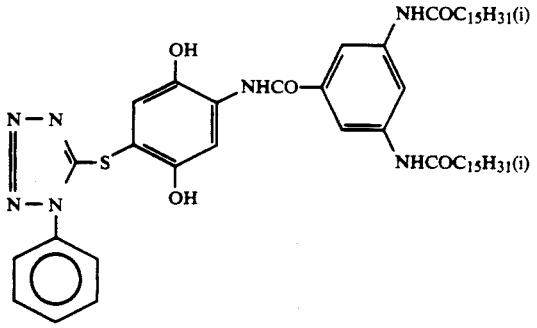
Hardening agent (1)
$CH_2{=}CHSO_2CH_2CONH(CH_2)_2NHCOCH_2SO_2CH{=}CH_2$ (1)-1
$CH_2{=}CHSO_2CH_2CONH(CH_2)_3NHCOCH_2SO_2CH{=}CH_2$ (1)-2
A 3:1 mixture of (1)-1 and (1)-2
Anti-fogging agent (2)
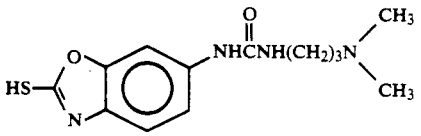
Anti-fogging agent (3)
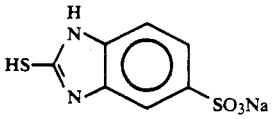
Dye-providing compound (1)
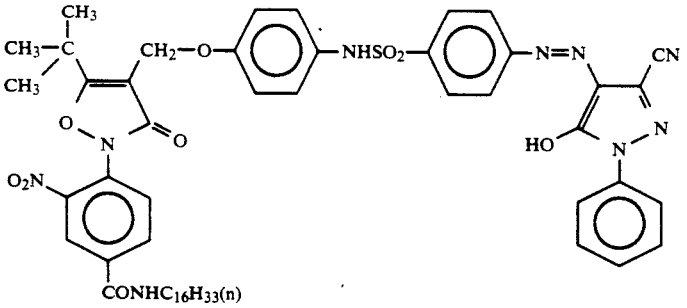
Dye-providing compound (2)
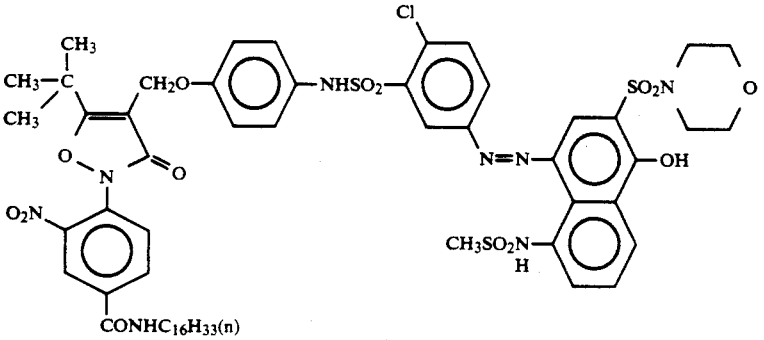
Dye-providing compound (3)

TABLE 1-continued

The structure of light-sensitive element 101

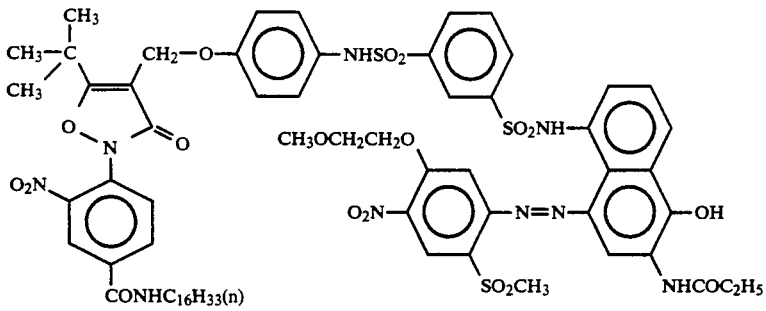

Reducing agent A

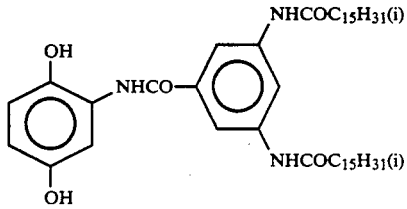

TABLE 2-A

The structure of dye-fixing element (1)

Surface layer (1) having a layer structure indicated in Table 2-B
Support (1) having a structure indicated in Table 2-D
Back layer (1) having a layer structure indicated in Table 2-C

TABLE 2-B

The structure of the surface layer (1)

| Layer No. | Additive | Amount ($g/m^2$) |
|---|---|---|
| Fourth Layer | Water-soluble polymer (1) | 0.25 |
| | Water-soluble polymer (2) | 0.07 |
| | Picolinic acid guanidine | 0.45 |
| | Surfactant (1) | 0.01 |
| | Surfactant (2) | 0.10 |
| | Surfactant (3) | 0.03 |
| Third Layer | Gelatin | 0.25 |
| | Water-soluble polymer (1) | 0.02 |
| | Surfactant (1) | 0.005 |
| | Surfactant (2) | 0.005 |
| | Hardening agent (1) | 0.16 |
| Second Layer | Gelatin | 1.40 |
| | Water-soluble polymer (1) | 0.20 |
| | Water-soluble polymer (3) | 0.60 |
| | Mordant (1) | 2.40 |
| | Picolinic acid guanidine | 2.20 |
| | Fluorescent brightener (1) | 0.055 |
| | Anti-staining agent (1) | 0.060 |
| | High-boiling organic solvent (1) | 1.40 |
| | Surfactant (4) | 0.025 |
| First Layer | Gelatin | 0.25 |
| | Water-soluble polymer (1) | 0.02 |
| | Surfactant (1) | 0.005 |
| | Surfactant (2) | 0.005 |
| | Hardening agent (1) | 0.16 |

TABLE 2-C

The structure of the back layer (1)

| Layer No. | Additive | Amount ($g/m^2$) |
|---|---|---|
| First back layer | Gelatin | 3.00 |
| | Water-soluble polymer (4) | 0.04 |

TABLE 2-C-continued

The structure of the back layer (1)

| Layer No. | Additive | Amount ($g/m^2$) |
|---|---|---|
| | Surfactant (1) | 0.05 |
| | Hardening agent (1) | 0.13 |
| Second back layer | Gelatin | 0.37 |
| | Water-soluble polymer (4) | 0.005 |
| | Surfactant (1) | 0.045 |
| | Surfactant (5) | 0.011 |
| | Matting agent (1) | 0.03 |

TABLE 2-D

The structure of the support (1)

| Name of Layer | Composition | Layer Thickness (μm) |
|---|---|---|
| Surface undercoat layer | Gelatin | 0.1 |
| Surface PE layer (glossy) | Low-density polyethylene (density: 0.923): 89.2 parts<br>Surface-treated titanium oxide: 10.0 parts<br>Ultramarine: 0.8 part | 20.0 |
| Pulp layer | Best quality paper (LBKP/NBKP = 1:1, density: 1.080) | 73.0 |
| Back PE layer (mat) | high-density polyethylene (density: 0.960) | 18.0 |
| Back undercoat layer | Gelatin | 0.05 |
| | Colloidal silica | 0.05 |
| | Total | 111.2 |

TABLE 2-E

The structure of the support (1)

| Item | Unit | Physical value | Measuring method |
|---|---|---|---|
| Stiffness (length/width) | g | 4.40/3.15 | Taper stiffness meter |
| Whiteness | | L* 94.20<br>a* +0.12<br>b* −2.75 | CLE L* a* b* |

Further materials mentioned above are defined below:

TABLE 2-E-continued

The structure of the support (1)

Water-soluble polymer (1):

Sumikagel L5-H (manufactured by Sumitomo Chemical Co., Ltd)

Water-soluble polymer (2):

Copper carrageenan (manufactured by Taito KK)

Water-soluble polymer (3):

Dextran (molecular weight: 70,000)

Water-soluble polymer (4):

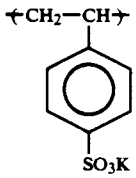

Surfactant (1)

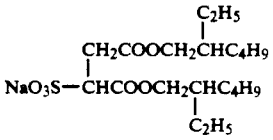

Surfactant (2)

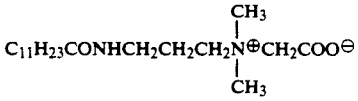

Surfactant (3)

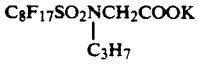

Surfactant (4)

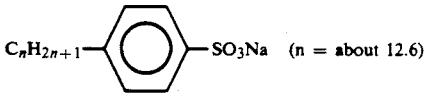

Surfactant (5)

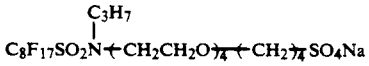

Hardening agent (1)

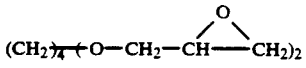

Fluorescent brightener:

2,5-Bis(5-t-benzoxazoyly (2))-thiophene

TABLE 2-E-continued

The structure of the support (1)

High-boiling organic solvent:

EMPARA (manufactured by Ajinomoto Co., Ltd.)

Matting agent:

Benzoguanamine resin (average particle size: 15 μm)

Mordant (1)

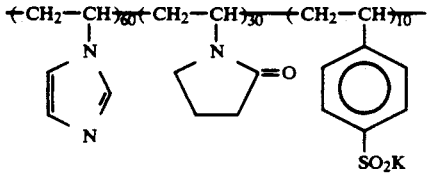

Anti-staining agent (1)

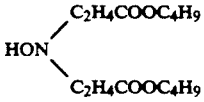

Each of light-sensitive elements 102 to 110 was prepared in the same manner as in the preparation of the light-sensitive element 101 except that each of the reducing agents of the present invention and comparative reducing agents indicated in Table 3 in an amount indicated in Table 3 was used in place of the reducing agent A used in the second and fourth layers of Table 1.

The above light-sensitive elements and the above dye-fixing element were processed by using an image recording device described in JP-A-2-84634.

Namely, the original image (a test chart on which yellow, magenta, cyan and gray wedges being recorded and density being continuously changed) was scanned through a slit on the light-sensitive element, and the light-sensitive element was exposed to light. The light-sensitive element was immersed in water kept at 40° C. for 5 seconds and squeezed by means of rollers. Immediately thereafter, the light-sensitive element and the dye-fixing element were put upon each other so as to allow the layer surfaces thereof to be brought into close contact with each other. The laminate was heated for 15 seconds by using heated rollers whose temperature was controlled so that the temperature of the surface of the layer which absorbed water became 80° C. The light-sensitive element and the dye-fixing element were then peeled off from each other. On the dye-fixing element, there was obtained a fresh color image corresponding to the original image.

Cyan density at a magenta image density of 1.5 and magenta density at a cyan image density of 1.5 were measured with X-Rite to examine color turbidity. Further, visual density, i.e., the maximum density (Dmax) and the minimum density (Dmin) in gray areas were measured. The results are shown in Table 3.

TABLE 3

| Light-sensitive element No. | Reducing agent in interlayer: Type | Amount in the 2nd layer ($mg/m^2$) | Amount in the 4th layer ($mg/m^2$) | Cyan density in magenta image | Magenta density in cyan image | Maximum density (Dmax) | Minimum density (Dmin) |
|---|---|---|---|---|---|---|---|
| 101 | Reducing agent A (comp. Ex.) | 130 | 130 | 0.30 | 0.45 | 2.2 | 0.15 |
| 102 | Reducing agent B (comp. Ex.) | 120 | 100 | 0.38 | 0.53 | 2.1 | 0.24 |
| 103 | Reducing agent C (comp. Ex.) | 130 | 130 | 0.30 | 0.44 | 2.2 | 0.18 |

TABLE 3-continued

| | | | | | | | |
|---|---|---|---|---|---|---|---|
| 104 | Reducing agent D (comp. Ex.) | 100 | 100 | 0.34 | 0.47 | 2.1 | 0.15 |
| 105 | Reducing agent E (comp. Ex.) | 80 | 80 | 0.31 | 0.46 | 2.2 | 0.15 |
| 106 | Reducing agent (2) (Invention) | 75 | 75 | 0.24 | 0.39 | 2.3 | 0.16 |
| 107 | Reducing agent (4) (Invention) | 85 | 85 | 0.23 | 0.39 | 2.2 | 0.15 |
| 108 | Reducing agent (7) (Invention) | 140 | 140 | 0.20 | 0.37 | 2.2 | 0.14 |
| 109 | Reducing agent (10) (Invention) | 90 | 90 | 0.23 | 0.39 | 2.2 | 0.14 |
| 110 | Reducing agent (14) (Invention) | 110 | 110 | 0.21 | 0.38 | 2.1 | 0.14 |

Reducing agent B

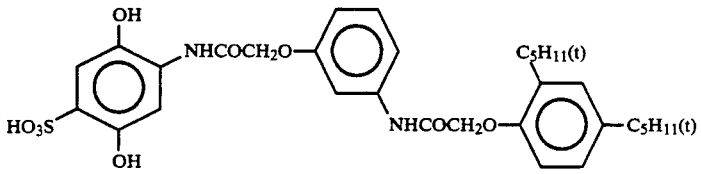

(Compound described in U.S. Pat. No. 4,198,239)

Reducing agent C

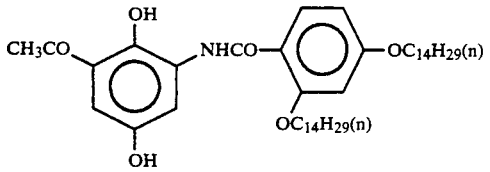

(Compound described in JP-A-63-198052 and EP-A-357040)

Reducing agent D

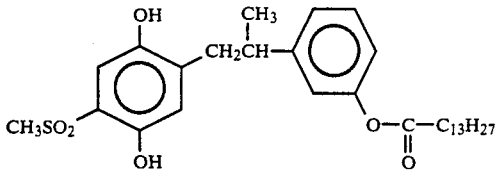

(Compound described in EP-A-351860)

Reducing agent E

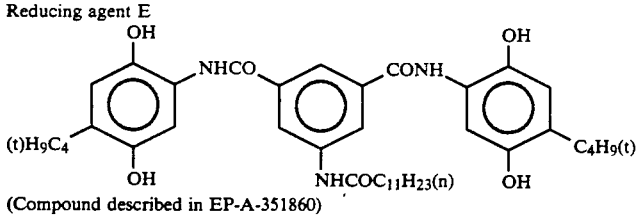

(Compound described in EP-A-351860)

Reducings agents (2), (4), (7), (10) and (14) are set forth in the general description of the invention above, and are covered by formula (I).

It is apparent from Table 3 that when the reducing agents of the present invention are used in the interlayers, color turbidity is surprisingly low and sufficient Dmax and Dmin can be obtained.

EXAMPLE 2

A light-sensitive element having a layer structure as indicated in Table 4 was prepared, and is referred to as light-sensitive element 201. Additives used in the light-sensitive element 201 had the same structure as those of the additives used in the light-sensitive element 101 unless otherwise specifically indicated.

A dye-fixing element (2) having the same structure as that of the dye-fixing element (1) was prepared except that the amount of picolinic acid guanidine used in the second layer was reduced to 1.00 g/m$^2$.

TABLE 4

The structure of the light-sensitive element 201

| Layer No. | Name of layer | Additive | Coating weight (mg/m$^2$) |
|---|---|---|---|
| Fourth layer | Protective layer | Gelatin | 900 |
| | | Silica (particle size: 4 μm) | 40 |
| | | Zinc hydroxide | 900 |
| | | Surfactant (1) | 130 |
| Third Layer | Magenta color material layer | Magenta dye providing compound (2) | 365 |
| | | Gelatin | 310 |
| | | Electron donor (1) | 158 |
| | | High-boiling solvent (1) | 183 |
| Second layer | Interlayer | Gelatin | 700 |
| | | Reducing agent B | 110 |
| | | High-boiling solvent (1) | 48 |

TABLE 4-continued

| The structure of the light-sensitive element 201 | | | |
|---|---|---|---|
| Layer No. | Name of layer | Additive | Coating weight (mg/m²) |
| | | Surfactant (2) | 61 |
| | | Hardening agent (1) | 30 |
| First layer | Emulsion layer | Silver halide emulsion | 230 in terms of silver |
| | | Gelatin | 330 |
| | | Electron donor (1) | 163 |
| | | High-boiling solvent (1) | 172 |
| | | Electron transfer agent (1) | 50 |
| | | Anti-fogging agnet (3) | 0.7 |

Support:
polyethylene terephthalate of 96 μm (carbon black was coated on the back layer)

Each of light-sensitive elements 202 to 208 was prepared in the same manner as in the preparation of the light-sensitive material 201 except that an equimolar amount of each of the reducing agents of the present invention and comparative reducing agents indicated in Table 5 was used in place of the reducing agent B used in the second layer of the light-sensitive element 201.

Unexposed and exposed light-sensitive elements 201 to 208 were immersed in water kept at 40° C. for 5 seconds and squeezed by using rollers. Immediately thereafter, each of the light-sensitive material and the dye fixing element (2) were put upon each other so as to allow the layer surfaces thereof to be brought into close contact with each other. The laminate was then heated for 10 seconds by using heated rollers whose temperature was controlled so that the temperature of the layer which absorbed water became 75° C. Subsequently, the light-sensitive element and the dye fixing element were peeled off from each other. The ratio of the magenta density of the exposed element to the magenta density of the unexposed element was determined. A layer ratio (nearer 1) means that the reducing agent in the interlayer has a larger effect of restraining the oxidant (radical) of the electron transfer agent (1) formed in the exposure area of the emulsion layer from diffusing into the magenta color material layer. The results are shown in Table 5.

TABLE 5

| Light-sensitive element No. | Type of reducing agent in the interlayer | Ratio of magenta density |
|---|---|---|
| 201 | reducing agent B (Comp. Ex.) | 0.59 |
| 202 | reducing agent F (Comp. Ex.) | 0.50 |
| 203 | reducing agent G (Comp. Ex.) | 0.52 |
| 204 | reducing agent H (Comp. Ex.) | 0.55 |
| 205 | reducing agent (4) (invention) | 0.77 |
| 206 | reducing agent (7) (invention) | 0.80 |
| 207 | reducing agent (8) (invention) | 0.73 |
| 208 | reducing agent (14) (invention) | 0.76 |

Reducing agent F

TABLE 5-continued

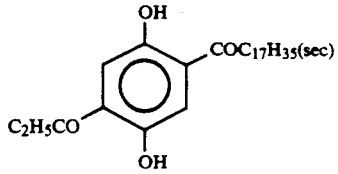

(Compound described in U.S. Pat. No. 4,277,553)

Reducing agent G

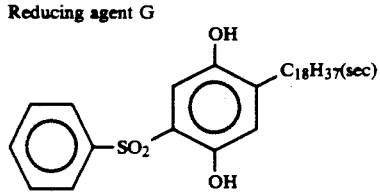

(Compound described in JP-A-61-75344)

Reducing agent H

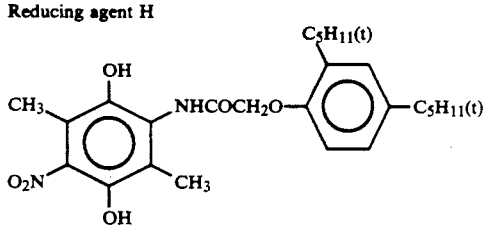

(Compound described in U.S. Pat. No. 4,277,553)

It is clear form Table 5 that the reducing agents of the present invention readily reduce the oxidant (radical) of the electron transfer agent and have a large effect of restraining the oxidant of the electron transfer agent from diffusing into other color material layers.

EXAMPLE 3

A light-sensitive element 301 having a layer structure as indicated in Table 6 was prepared. Additives having the same structure as those used in the light-sensitive element 101 were used unless otherwise specifically stated.

TABLE 6

| The structure of the light-sensitive element 301 | | | |
|---|---|---|---|
| Layer No. | Name of layer | Additive | Coating weight (mg/m²) |
| Eleventh layer | Protective layer | Gelatin | 400 |
| | | Silica (particle size: 4 μm) | 250 |
| | | Hardening agent (1) | 48 |
| | | Surfactant (2) | 12 |
| | | Citric acid | 16 |
| Tenth layer | Blue-sensitive emulsion layer | Blue-sensitive silver halide emulsion | 500 in terms of silver |
| | | Gelatin | 410 |
| | | Anti-fogging agent (3) | 0.16 |
| | | Surfactant (1) | 6.5 |
| Ninth layer | Yellow color material layer | Yellow dye providing compound (1) | 420 |
| | | Electron donor (2) | 230 |
| | | Gelatin | 510 |
| | | High-boiling solvent (1) | 210 |
| | | Surfactant (1) | 48 |
| Eighth layer | Interlayer | Gelatin | 320 |
| | | Surfactant (2) | 11 |
| Seventh layer | Interlayer | Reducing agent A | 388 |
| | | High-boiling solvent (1) | 143 |
| | | Surfactant (1) | 11 |
| | | Stabilizer (1) | 2.4 |
| | | Gelatin | 450 |
| | | Citric acid | 14 |

TABLE 6-continued

| | | | |
|---|---|---|---|
| Sixth layer | Green-sensitive emulsion layer | Green-sensitive silver halide emulsion | 320 in terms of silver |
| | | Gelatin | 380 |
| | | Anti-fogging agent (3) | 0.10 |
| | | Surfactant (1) | 6.5 |
| Fifth layer | Magenta color material layer | Magenta dye providing compound (2) | 390 |
| | | Electron donor (2) | 170 |
| | | High-boiling solvent (1) | 195 |
| | | Gelatin | 390 |
| | | Surfactant (1) | 35 |
| Fourth layer | Interlayer | Gelatin | 320 |
| | | Surfactant (2) | 11 |
| Third layer | Interlayer | Reducing agent A | 388 |
| | | High-boiling solvent (1) | 143 |
| | | Surfactant (1) | 11 |
| | | Stabilizer (1) | 2.4 |
| | | Gelatin | 450 |
| | | Citric acid | 14 |
| Second layer | Red-sensitive emulsion layer | Red-sensitive silver halide emulsion | 270 in terms of silver |
| | | Gelatin | 380 |
| | | Anti-fogging (3) | 0.09 |
| | | Surfactant (1) | 6.5 |
| First layer | Cyan color material layer | Cyan dye providing compound (3) | 410 |
| | | Electron donor (2) | 160 |
| | | High-boiling solvent (1) | 205 |
| | | Gelatin | 400 |
| | | Surfactant (1) | 40 |
| Support | polyethylene terephthalate of 100 μm | | |
| Back layer | | Carbon black | 4000 |
| | | Gelatin | 2000 |

Electron donor (2)

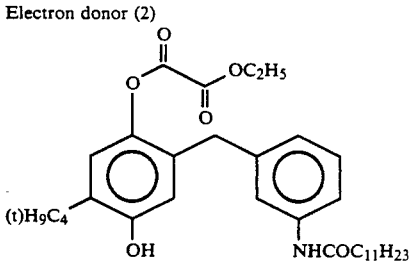

Stabilizer (1)

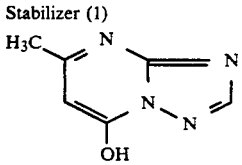

Each of light-sensitive elements 302 and 303 was prepared in the same manner as in the preparation of the light-sensitive element 301 except that an equimolar amount of the reducing agent (6) or (12) of the present invention was used in place of the reducing agent A used in the third and seventh layers.

A dye fixing element (3) was prepared in the following manner.

Paper Support

Both sides of paper of 150 μm in thickness were laminated with a 30 μm thick polyethylene. Polyethylene on the image receiving side contained 10% by weight (based on the weight of polyethylene) of titanium dioxide dispersed therein.

Back Side (a) A light screening layer containing 4.0 g/m² of carbon black and 2.0 g/m² of gelatin.

(b) A white color layer containing 8.0 g/m² of titanium dioxide and 1.0 g/m² of gelatin.

(c) A protective layer containing 0.6 g/m² of gelatin.

The above layers in order of (a), (b) and (c) were coated and hardened by a hardening agent.

Image-Receiving Layer Side (1) A neutralization layer containing 22 g/m² of an acrylic acid-butyl acrylate copolymer (8:2 by molar ratio) having an average molecular weight of 50,000.

(2) A second timing layer containing cellulose acetate having a degree of acetylation of 51.3% (the weight of acetic acid released by hydrolysis being 0.513 g per gram of the sample) and a styrene-maleic anhydride copolymer (1:1 by molar ratio) having an average molecular weight of about 10,000 in the combined amount of 4.5 g/m² in a ratio of 95:5 by weight.

(3) An interlayer containing 0.4 g/m² of poly-2-hydroxyethyl methacrylate.

(4) A first timing layer containing 1.6 g/m² (on a total solid basis) of a blend consisting of a polymer latex obtained by emulsion-polymerizing styrene/butyl acrylate/acrylic acid/N-methylol acrylamide in a ratio of 49.7/42.3/4/4 by weight and a polymer latex obtained by emulsion-polymerizing methyl methacrylate/acrylic acid/N-methylol acrylamide in a ratio of 93/3/4 by weight in a ratio of 6:4 by weight on a solid basis.

(5) An image-receiving layer coated with 3.0 g/m² of a polymer mordant comprising the following repeating units

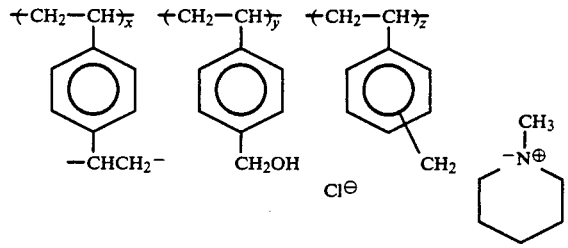

x:y:z = 5:5:90 and 3.0 g/m² of gelatin by using a compound, as a coating aid, represented by the following formula.

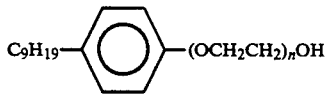

(n = 30)

(6) A protective layer coated with 0.6 g/m² Of gelatin.

The above layers (1) to (6) in this order were coated and hardened by a hardening agent. The formulation of the processing solution:

0.8 g of a processing solution having the following composition was charged into a rupturable container.

| | |
|---|---|
| 1-p-Tolyl-4-hydroxymethyl-4-methyl-3-pyrazolidone | 10.0 g |
| 1-phenyl-4-hydroxymethyl-4-methyl-3-pyrazolidone | 4.0 g |
| Potassium sulfite (anhydrous) | 4.0 g |
| Hydroxyethyl cellulose | 40 g |
| Potassium hydroxide | 64 g |

-continued

| | |
|---|---|
| Benzyl alcohol | 2.0 g |
| Add water to make (total amount) | 1 kg |

Each of the light-sensitive elements 301 to 303 was exposed to light through yellow, magenta, cyan and gray color separation wedges. Each of the light-sensitive elements and the image receiving side of the dye-fixing element (3) were then put upon each other. The above processing solution was spread with a thickness of 60 μm therebetween by the aid of pressure rollers. The processing was carried out at 35° C. After one minute, the light-sensitive element and the dye-fixing element were peeled off from each other.

In the same manner as in Example 1, color turbidity, Dmax and Dmin were measured. It was found that the light-sensitive elements 302 and 303 containing the reducing agents of the present invention showed less color turbidity and had sufficient Dmax and Dmin in comparison with the light-sensitive element 301.

It will be understood from the above disclosure that according to the present invention, there can be obtained color images which are excellent in color reproducibility and have sufficient discrimination.

While the invention has been described in detail and with reference to specific embodiments thereof, it will be apparent to one skilled in the art that various changes and modifications can be made therein without departing from the spirit and the scope of the present invention.

What is claimed is:

1. A color light-sensitive material comprising a support having thereon at least one light-sensitive layer containing light-sensitive silver halide, and further comprising in the at least one light-sensitive layer or any other layer, independently, a binder, a reducible dye-providing compound, and a reducing agent represented by formula (I):

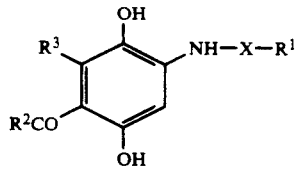

(I)

wherein X represents —CO— or —$SO_2$—; $R^1$ and $R^2$, which may be the same or different, each represents an alkyl group, an aryl group or a heterocyclic group, any of which groups may be substituted; $R^3$ represents a hydrogen atom, a halogen atom, an aryl group, an acylamino group, an alkoxy group, an aryloxy group, an alkylthio group, an arylthio group, an acyl group, a sulfonyl group, a carbamoyl group or a sulfamoyl group, any of which groups may be substituted; $R^2$ and $R^3$ may be combined together to form a carbocyclic ring or a heterocyclic ring; and the reducing agent may be in the form of a dimer or a trimer through $R^1$ or $R^2$.

2. The color light-sensitive material as in claim 1, wherein the alkyl group and heterocyclic group independently represented by $R^1$ and $R^2$ each comprises from 1 to 100 carbon atoms, and the aryl group independently represented by $R^1$ and $R^2$ each comprises from 6 to 100 carbon atoms.

3. The color light-sensitive material as in claim 1, wherein at least one of the alkyl group, aryl group or heterocyclic group independently represented by $R^1$ and $R^2$ comprises at least one substituent selected from the group consisting of an alkyl group, an aryl group, an alkoxy group, an aryloxy group, a carboxyl group, an alkylcarbonyl group, an arylcarbonyl group, an alkoxycarbonyl group, an aryloxycarbonyl group, an acyloxy group, a sulfamoyl group, a carbamoyl group, a sulfonamido group, an acylamino group, a diacylamino group, a sulfonyl group, a hydroxyl group, a cyano group, a nitro group and a halogen atom.

4. The color light-sensitive material as in claim 1, wherein for the groups represented by $R^3$, the aryl, arylthio and aryloxy groups comprise from 6 to 100 carbon atoms, the acylamino and acyl groups comprise from 2 to 100 carbon atoms, the alkoxy, alkylthio, sulfonyl and carbamoyl groups comprise from 1 to 100 carbon atoms, and the sulfamoyl group comprises from 0 to 100 carbon atom.

5. The color light-sensitive material as in claim 1, wherein $R^2$ and $R^3$ combine to form a five- to eight-membered carbocyclic or heterocyclic ring.

6. The color light-sensitive material as in claim 1, wherein X is —CO—.

7. The color light-sensitive material as in claim 1, wherein the sum total of carbon atoms in $R^1$, $R^2$ and $R^3$ is from 20 to 200.

8. The color light-sensitive material as in claim 1, wherein $R^3$ is a hydrogen atom or a halogen atom.

9. The color light-sensitive material as in claim 1, wherein the reducing agent of formula (I) is present in at least one layer in an amount of from 0.05 to 50 mmol per $m^2$ of the support, or in an amount of from 0.01 to 50 mmol per gram of binder in a layer to which the reducing agent is present.

10. The color light-sensitive material as in claim 9, wherein the reducing agent is present in said at least one layer in an amount of from 0.1 to 5 mmol per $m^2$ of the support, or in an amount of from 0.1 to 5 mmol per gram of the binder in the layer to which the reducing agent is present.

11. The color light-sensitive material as in claim 9, wherein said at least one layer is an interlayer or a protective layer.

12. The color light-sensitive material as in light-sensitive layers having different color sensitives from each other, and an interlayer between the two light-sensitive layers comprises said reducing agent.

13. The color light-sensitive material as in claim 1, wherein the material comprises a light-sensitive element containing said at least one light-sensitive layer, and a dye-fixing element.

14. The color light-sensitive material as in claim 13, wherein said reducing agent is present in the light-sensitive element.

15. The color light-sensitive material as in claim 14, wherein said reducing agent is present in at least one interlayer of the light-sensitive element.

* * * * *